United States Patent [19]

Drew

[11] 4,120,101

[45] Oct. 17, 1978

[54] ORTHOPAEDIC FOOTWEAR

[76] Inventor: John Alan Drew, 433 Uxbridge Rd. Ealing, London W.5., England

[21] Appl. No.: 750,716

[22] Filed: Dec. 15, 1976

[30] Foreign Application Priority Data

Jul. 7, 1976 [GB] United Kingdom ..... 28295/76

[51] Int. Cl.[2] ..... A43B 1/10; A43B 23/00

[52] U.S. Cl. ..... 36/4; 36/57

[58] Field of Search ..... 36/83, 4, 7.3, 7.1, 36/45, 57, 43, 44, 55

[56] References Cited

U.S. PATENT DOCUMENTS

| | | | |
|---|---|---|---|
| 1,519,009 | 12/1924 | Reina | 36/43 |
| 1,739,612 | 12/1924 | Riley | 12/142 EV |
| 2,433,228 | 12/1947 | Hollier | 36/7.3 |
| 2,599,116 | 6/1952 | Margulis | 36/7.3 |
| 2,724,676 | 11/1955 | Randall et al. | 36/55 X |
| 3,530,489 | 9/1970 | Appleton | 36/55 X |

FOREIGN PATENT DOCUMENTS

| | | | |
|---|---|---|---|
| 2,422,393 | 11/1975 | Fed. Rep. of Germany | 36/55 |

*Primary Examiner*—Patrick D. Lawson

*Attorney, Agent, or Firm*—Rogers, Eilers & Howell

[57] ABSTRACT

An article of orthopaedic footwear comprises an upper of thermosoftening plastics material, e.g. a vinyl polyer, having a lining of resilient expanded thermosoftening plastics material of closed cell construction, e.g. an expanded cross-linked polyethylene. The upper has an autogenously welded seam covered externally by a strip of thermosoftening plastics material, e.g. a vinyl polymer, autogenously welded to the upper on both sides of the seam, e.g. by longitudinal and/or transverse welds. The article can be shaped by forming and/or cutting the upper.

9 Claims, 8 Drawing Figures

FIG. 1.
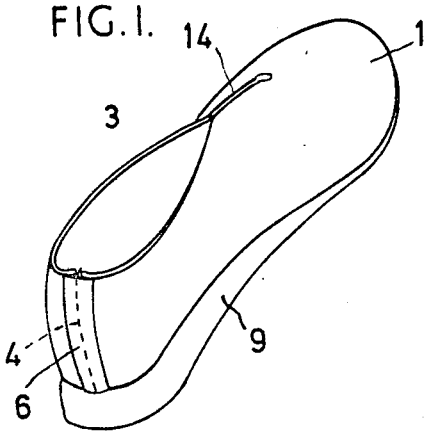
FIG. 2.
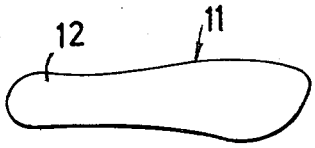
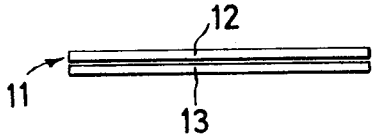
FIG. 3.
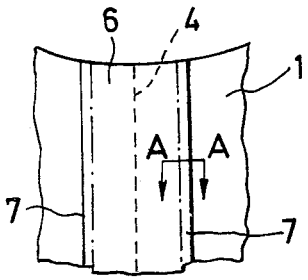
FIG. 4.
FIG. 5.
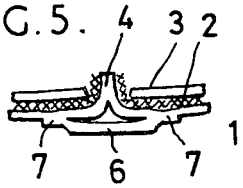
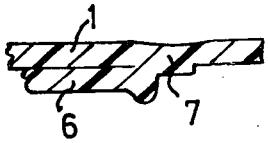
FIG. 6.
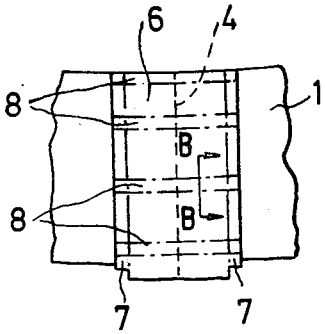
FIG. 7.
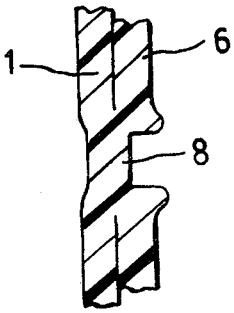
FIG. 8.

ORTHOPAEDIC FOOTWEAR

BACKGROUND AND SUMMARY OF THE INVENTION

The invention relates to an article of orthopaedic footwear constructed of plastics material, and to a method of making such an article.

A number of processes for making orthopaedic footwear are already known, but these result in articles which have a very limited life. Furthermore, the articles produced are not adaptable to the wide range of deformities which are met with in practice; i.e. each article of footwear is made to an individual design.

The present invention provides an article of orthopaedic footwear comprising an upper secured to a sole, the upper being of thermosoftening plastics material and having a lining of resilient expanded thermosoftening plastics material of closed cell construction, in which the upper has an autogenously welded seam covered externally by a strip of thermosoftening plastics material autogenously welded to the upper on both sides of the seam.

This article of footwear thus has a particularly strong seam construction. The article can be shaped to suit the patient, by forming and/or cutting the upper, without substantial restriction, since the seam construction is equally suitable for forming and cutting. For instance, if the article is in the form of a bootee, the seam being at the rear, the ankle portion and/or the heel portion can be formed and/or cut in order to suit the patient. Thus, articles in accordance with the invention can be supplied as stock items which can subsequently be adapted to the shape required.

The invention also provides a method of making the above article comprising vacuum-forming an upper from thermosoftening sheet plastics material having a lining of resilient expanded thermosoftening plastics material, autogenously welding the sheet plastics material by diathermy (high frequency heating) to form a seam, externally covering the seam with a strip of thermosoftening plastics material, autogenously welding the strip to the upper on both sides of the seam by diathermy, and securing the upper to a sole.

Preferably there is a longitudinal weld along each of the longitudinal edges of the strip. Alternatively or (preferably) additionally, there may be transverse welds spaced along the strip; if it is subsequently necessary to cut across the seam, the cut can be made along one of the transverse welds, so that there are no loose portions which might be weakened by flexing.

The article of footwear preferably has a removable insole of resilient expanded thermoplastic material. The insole can thus be removed from the article, shaped to the patient's foot, and replaced. A preferred insole comprises a top layer of lower density and a separate bottom layer of higher density.

The plastics material of the upper and of the strip is preferably a vinyl polymer, e.g. polyvinylchloride (PVC). The upper may have a backing of thermosoftening textile material bonded to the upper, between the upper and its lining. The expanded plastics material used in the article is preferably an expanded cross-linked polyethylene.

There may, of course, be more than one seam in the upper, each seam being covered by a strip as described above. For instance, there may be an seam at the toe and at the heel.

DESCRIPTION OF THE DRAWINGS

The invention will be described further, by way of example only, with reference to the accompanying drawings, in which:

FIG. 1 is a perspective view of an orthopaedic shoe;

FIG. 2 is a plan view of the insole of the shoe;

FIG. 3 is a side view of the insole;

FIG. 4 is an enlarged view of part of the rear end of the shoe, showing the covered seam construction;

FIG. 5 is a plan view of the covered seam construction of FIG. 4;

FIG. 6 is a section through a longitudinal weld, on line A—A in FIG. 4;

FIG. 7 is similar to FIG. 4, showing another covered seam construction; and

FIG. 8 is a section through a transverse weld, on line B—B in FIG. 7.

DESCRIPTION OF THE PREFERRED EMBODIMENTS

The shoe illustrated has an upper 1 of PVC bonded to a backing 2 of thermosoftening textile material which is in turn bonded to a lining 3 of a low density "Plastazote" (a Trade Mark for an expanded cross-linked polyethylene). The upper is made by a vacuum-forming a flat blank on a last. With the upper turned inside out, the PVC is autogenously welded by diathermy in the heel region to form a seam 4.

A strip 6 of PVC is placed on the exterior of the upper 1 so as to cover the seam 4. As shown in FIGS. 4 to 6, the strip 6 is autogenously welded to the upper 1 by diathermy along two longitudinal welds 7 at the edges of the strip. FIG. 6 shows a weld 7 in cross-section, and it will be noted that there is no interface between the two welded materials at the position of the weld; the weld 7 is thus substantially equal in strength to the strip 6.

Flexing of the strip 6 between the welds 7 can weaken the strip. This can be prevented, as shown in FIGS. 7 and 8, by forming transverse welds 8 at the same time as the longitudinal welds 7. The welds 8 are spaced along the strip 6. If the heel of the upper is to be partially cut away to suit the patient's foot, it is easy to ensure that the cut passes along one of the welds 8, so that the strip 6 has no unwelded edge which could be a point of weakness.

The transverse welds 8 result in transverse recesses in the lining 3, the recesses therefore separating transverse ridges which act as a moulded heel grip. This effectively reduces slip between the inner rear surface of the upper and the patient's heel. This rear surface can be moulded to individual requirements.

The upper 1 is adhesively secured to a sole 9. An insole 11 (FIGS. 2 and 3) is fitted in the shoe. It comprises a top layer 12 of low-density "Plastazote" and a separate bottom layer 13 of high-density "Plastazote". The insole 11 can be removed for replacement or shaping.

A "Velcro" (Trade Mark) connection is secured to the exterior of the upper over the slit 14 seen in FIG. 1.

Various modifications may be made within the scope of the invention. For instance, the longitudinal seams 7 could be omitted from the construction shown in FIG. 7. The upper could be vacuum-formed in two halves, which would then be welded together by two seams, one at the heel, the other at the toe.

I claim:

1. An article of orthopedic footwear adapted to be selectively modified to conform to the foot of the wearer having a sole, an upper sheet of thermosoftening material secured to the sole, the upper sheet having two edges permanently joined at a seam, strip of thermosoftening material having edges that are welded to the outer surface of the upper sheet covering the seam, the article having means allowing trimming of the article to selectively modify the article to conform to the foot of the wearer and to retain the structural integrity and modified shape of the article when so modified.

2. The article of claim 1 wherein the article has an upper of vinyl polymer plastic material formed with an autogenously welded seam at the heel of the article; a backing of thermosoftening textile material bonded to the upper; a liner of expanded cross-linked plastic material bonded to the backing; a strip of vinyl polymer plastic material autogenously welded to the outer surface of the upper and covering the seam; and having means allowing triming of the article to selectively modify the article to conform the article to the foot of the wearer and retain the structural integrity and modified shape of the article when so modified by trimming across the seam and strip of vinyl polymer plastic material; a removable insole having a top layer of low density plastic material, and a bottom layer of high density plastic material; and means defining a slit in the instep area of the upper to aid in putting on and removing the footwear and means for securing the slit in a closed condition during wearing of the footwear.

3. The article of claim 1 wherein the article has a lining of thermosoftening material on the inner surface of the upper and the lining is made of resilient expanded thermosoftening plastic material of closed cell construction.

4. The article of claim 4 wherein the lining is made of an expanded cross-linked polyethylene.

5. The article of claim 3 wherein the article has a backing sheet of thermosoftening textile material between the upper sheet and the lining and wherein the backing sheet is bonded to the upper sheet and the lining.

6. The article of claim 1 wherein the strip of thermosoftening material has a plurality of transverse welds spaced along the strip, said transverse welds forming means to allow selective modification of the article by trimming along a weld and retaining the structural integrity of the trimmed article.

7. The article of claim 1 wherein the upper sheet and the strip are made of a vinyl polymer plastic material.

8. The article of claim 1 wherein the article has a removable insole of resilient expanded thermosoftening material, the insole having two layers, the bottom layer, normally contacting the article when used therein, being of greater density than the top layer.

9. An article of orthopedic footwear adapted to be selectively modified to conform to the foot of the individual wearer comprising a sole; an upper of vinyl polymer plastic material secured to the sole and formed with an autogenously welded seam at the heel of the article; a backing of thermosoftening textile material bonded to the upper; a liner of expanded cross-linked plastic material bonded to the backing; a strip of vinyl polymer plastic material autogenously welded to the outer surface of the upper and covering the seam; the weld including a longitudinal weld along each longitudinal edge of the strip and a plurality of transverse welds spaced along the strip forming a plurality of cavities between the upper sheet and the strip between the transverse welds and forming a plurality of transverse ridges along the inner surface of the heel area of the article to grip the foot of the wearer, the transverse welds forming means to allow selective modification of the article by trimming along a weld and retaining the structural integrity of the trimmed article; a removable insole having a top layer of low density expanded cross-linked plastic material, and a bottom layer of high density plastic material; and means defining a slit in the instep area of the upper to aid in putting on and removing the footwear and means for securing the slit in a closed condition during wearing of the footwear.

* * * * *